US007304847B2

(12) United States Patent
Hwang et al.

(10) Patent No.: US 7,304,847 B2
(45) Date of Patent: Dec. 4, 2007

(54) HEAT SINK

(75) Inventors: Ching-Bai Hwang, Tu Cheng (TW); Jin-Gong Meng, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 40 days.

(21) Appl. No.: 11/308,728

(22) Filed: Apr. 26, 2006

(65) Prior Publication Data

US 2007/0188992 A1 Aug. 16, 2007

(30) Foreign Application Priority Data

Feb. 10, 2006 (CN) ..... 200610033568.9

(51) Int. Cl.
*H05K 7/20* (2006.01)

(52) U.S. Cl. ..... 361/700; 361/697; 361/703; 361/709; 165/80.3; 165/122; 165/151; 165/104.33; 165/185; 257/E23.099; 174/16.3

(58) Field of Classification Search ..... 361/690, 361/691, 697, 700, 709; 165/80.3, 104.33, 165/104.26, 152.122, 185; 257/E23.099, 257/E23.088
See application file for complete search history.

(56) References Cited

U.S. PATENT DOCUMENTS

| | | | | |
|---|---|---|---|---|
| 5,358,032 | A * | 10/1994 | Arai et al. | 165/80.3 |
| 5,957,194 | A * | 9/1999 | Azar | 165/80.3 |
| 6,478,082 | B1 * | 11/2002 | Li | 165/185 |
| 6,668,910 | B2 * | 12/2003 | Gawve | 165/80.3 |
| 6,826,050 | B2 * | 11/2004 | Suzuki | 361/703 |
| 6,976,529 | B2 * | 12/2005 | Kester | 165/151 |
| 7,180,740 | B2 * | 2/2007 | Li et al. | 361/697 |
| 7,243,708 | B2 * | 7/2007 | Lee et al. | 165/104.33 |
| 7,245,492 | B2 * | 7/2007 | Huang | 361/697 |
| 2005/0190538 | A1 | 9/2005 | Huang | |
| 2007/0089869 | A1 * | 4/2007 | Hwang et al. | 165/152 |

* cited by examiner

*Primary Examiner*—Boris Chervinsky
*Assistant Examiner*—Courtney Smith
(74) *Attorney, Agent, or Firm*—Jeffrey T. Knapp

(57) ABSTRACT

A heat sink includes a plurality of fins parallel to each other, and one heat pipe extending through these fins. A flow channel is formed between each pair of neighboring fins for channeling an airflow generated by an electric fan. A guiding member having a curved shape is arranged around the through hole for guiding the airflow flowing to the heat pipe. A space formed and surrounded by the guiding member is a tapered space, which narrows gradually along the direction of the airflow so as to guide the airflow flowing to the heat pipe.

15 Claims, 5 Drawing Sheets

HEAT SINK

FIELD OF THE INVENTION

The present invention relates generally to a heat sink, and in particular to a heat sink with improved fin structure for achieving a high heat-dissipation efficiency.

DESCRIPTION OF RELATED ART

With the advance of large scale integrated circuit technology, and the wide spread use of computers in all trades and occupations, in order to meet the required improvement in data processing load and request-response times, high speed processors have become faster and faster, which causes the processors to generate redundant heat. Redundant heat which is not quickly removed will have tremendous influence on the system security and performance. Usually, people install a heat sink on the central processor to assist its heat dissipation, whilst also installing a fan on the heat sink, to provide a forced airflow to increase heat dissipation.

FIG. 5 shows a conventional heat sink 1. The heat sink 1 comprises a fin unit 2, a heat pipe 4 extending through the fin unit 2, and a cooling fan (not shown) arranged at a side of the fin unit 2 so as to generate an airflow flows through the fin unit 2. The fin unit 2 comprises a plurality of fins stacked together. Each fin is planar and parallel to each other. A flow channel 3 is formed between two adjacent fins. The heat pipe 4 includes an evaporating section for thermally connecting with a heat-generating electronic device and condensing sections extending into through holes of the fin unit 2 and thermally connecting with the fins.

During operation of the heat-generating electronic device, the heat pipe 4 absorbs heat generated by the heat-generating electronic device. The heat is moved from the evaporating section to the condensing sections and then on to the fins of the fin unit 2. At the same time, the airflow that is generated by the cooling fan flows through the flow channels 3 to exchange heat with the fins. The heat is dissipated to the surrounding environment by the airflow. Thus, heat dissipation of the heat-generating electronic device is accomplished.

For enhancing the heat dissipation effectiveness of this heat sink 1, the heat dissipation area of the fin unit 2 needs to be increased. One way to increase the heat dissipation area of the fin unit 2 is to accommodate more fins or to increase the size of each fin. However, this increases the weight of the heat sink, which conflicts with the requirement for light weight and compactness. Another way to increase the heat dissipation area of the fin unit 2 is reducing the spacing distance of two adjacent fins, so that the fin unit 2 can accommodate more fins. This way may avoid increasing the volume of heat sink 1, however, reducing the spacing between two adjacent fins of the fin unit 2 will increase the flow resistance, which not only influences the heat dissipation effect but also increases the noise. Also, due to the planar shape of each fin of the fin unit 2, a part of the airflow that is generated by the cooling fan escapes from the fin unit 2 around it's lateral sides, before the airflow reaches the other side of the fin unit that is opposite to the cooling fan. It causes reduction in the heat exchange with the fin unit 2. Therefore, the airflow flowing through the fin unit cannot sufficiently assist heat dissipation from a heat-generating electronic device. Furthermore, due to the influence of viscosity, a laminar air envelope may form at the surface of the fin unit 2, when the airflow flows through the fin unit 2. The flowing speed of the airflow in this laminar first floor is nearly zero; the main way of heat exchange between the airflow and the fin unit 2 is heat conduction and the heat exchange effect is thus greatly reduced. Accordingly, heat dissipation effectiveness of the conventional heat sink 1 is limited.

What is needed, therefore, is a heat sink having a high heat dissipation effectiveness without increasing the size and the weight of the fin unit.

SUMMARY OF INVENTION

According to a preferred embodiment of the present invention, a heat sink comprises a plurality of fins parallel to each other, and one heat pipe extending through these fins. A cooling fan is arranged at a side of the fins for generating an airflow to flow through the fins. A through hole is defined in each of the fins for extension of the heat pipe. A flow channel is formed between each two neighboring fins for channeling the airflow. A guiding member having a curved shape is arranged around the through hole. A tapered space is formed and surrounded by the guiding member and decreases gradually along the direction of the airflow, thus guiding the airflow flowing to the heat pipe.

The guiding member formed in each fin of the heat sink can guide the distribution and flow direction of the airflow whilst simultaneously enhancing the turbulence on the surface of the fin. Thus the fin unit can have a sufficient heat exchange with the airflow, effectively dissipating the heat of the fin unit that is absorbed from the heat-generating electronic device to the surrounding environment.

Other advantages and novel features of the present invention will be drawn from the following detailed description of the preferred embodiment of the present invention with attached drawings, in which:

DETAILED DESCRIPTION

Figure 1:
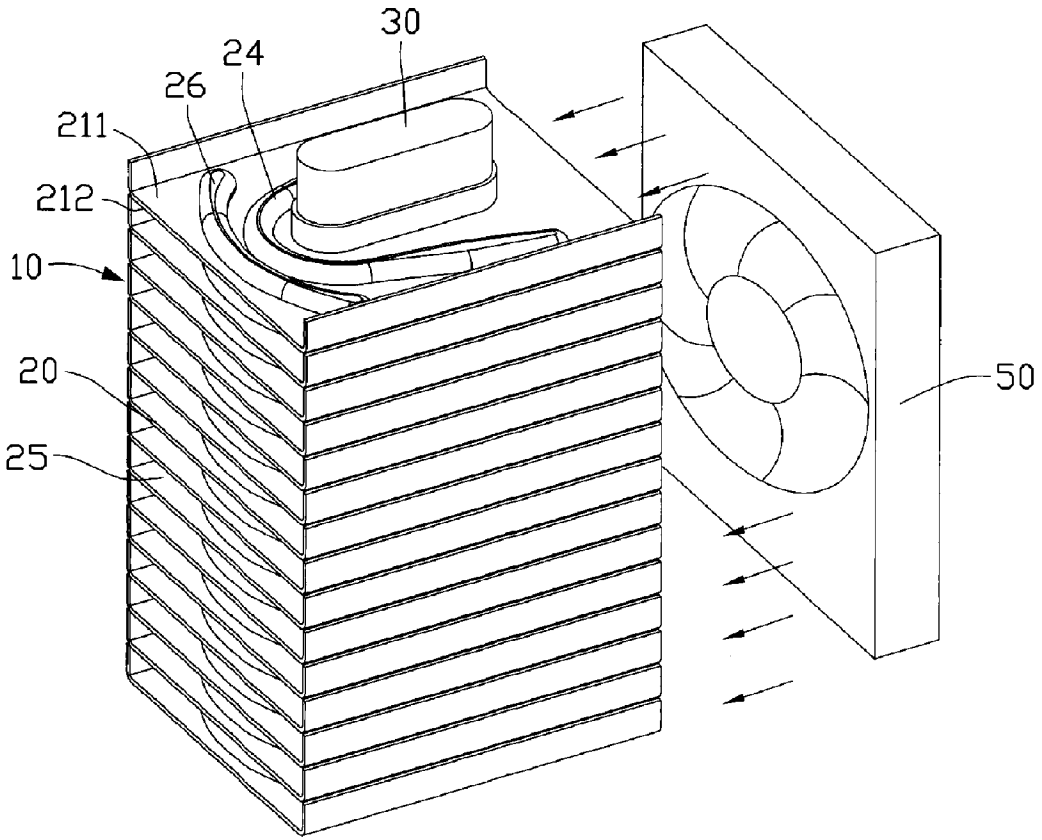
FIG. 1 is an assembled, isometric view of a heat sink in accordance with a preferred embodiment of the present invention and an electric fan.

Referring to FIG. 1, a heat sink comprises a fin unit 10, and a heat pipe 30 extending through the fin unit 10. The heat pipe 30 has an evaporating section (not labeled) for thermally connecting with a heat source, for example, a central processing unit (CPU, not shown). A cooling fan 50 is arranged at a side of the fin unit 10 for generating an airflow towards the fin unit 10 as indicated by arrows.

Figure 2:
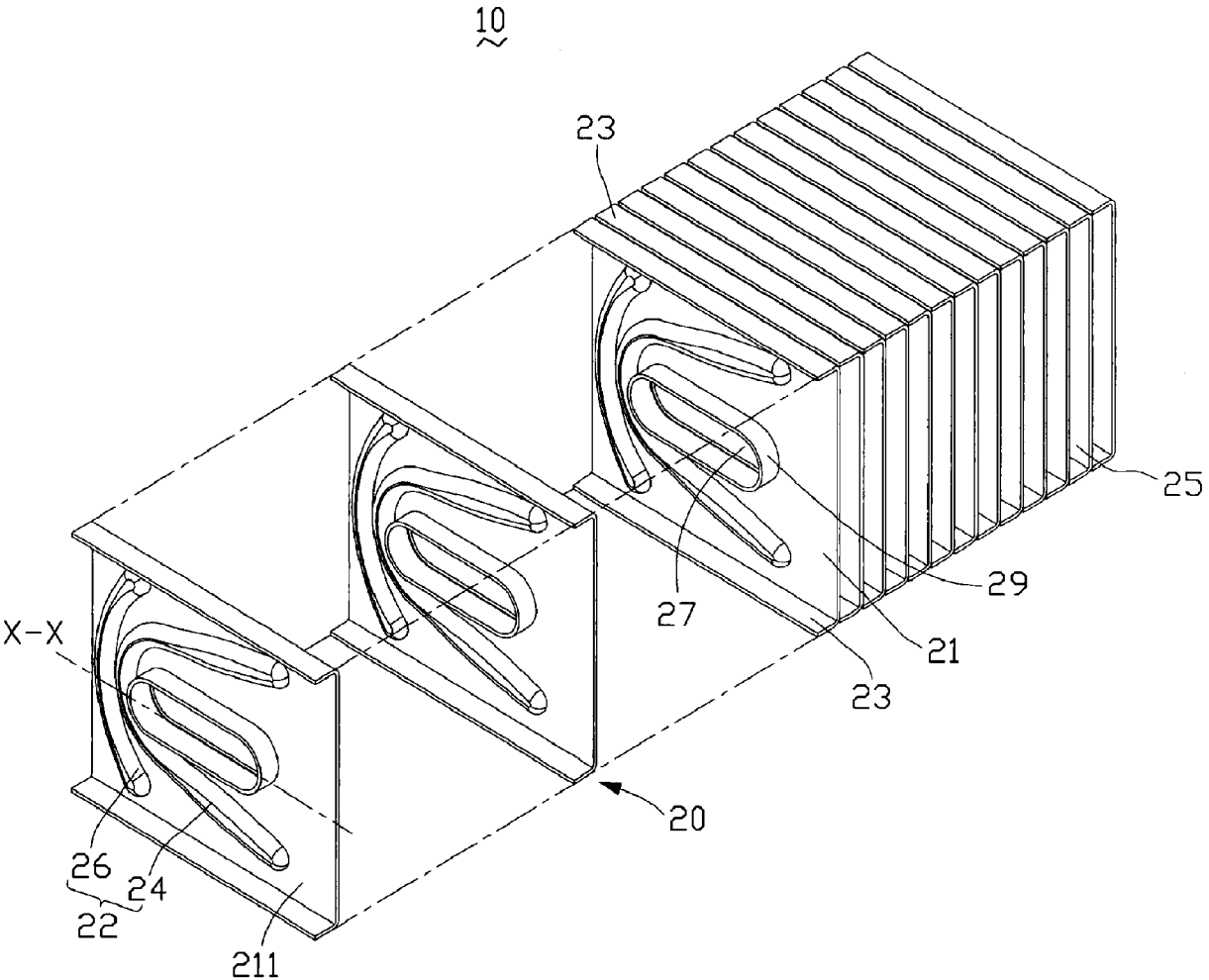
FIG. 2 is an assembled, isometric view of a fin unit of the heat sink of FIG. 1, with some of fins of the fin unit being omitted for clearly showing structure of the fins.
Figure 3:
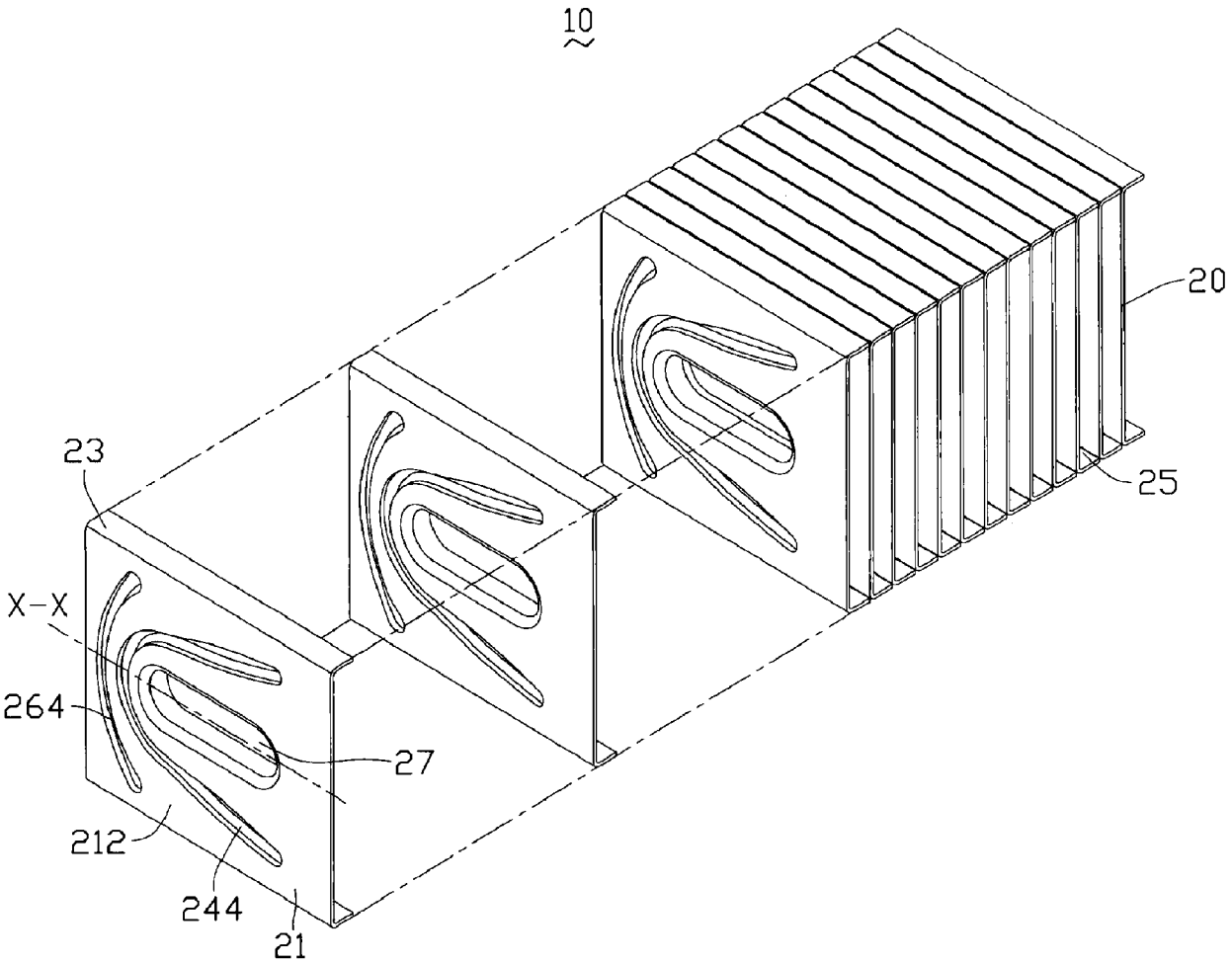
FIG. 3 is a view similar to FIG. 2, from a different aspect.
Figure 4:
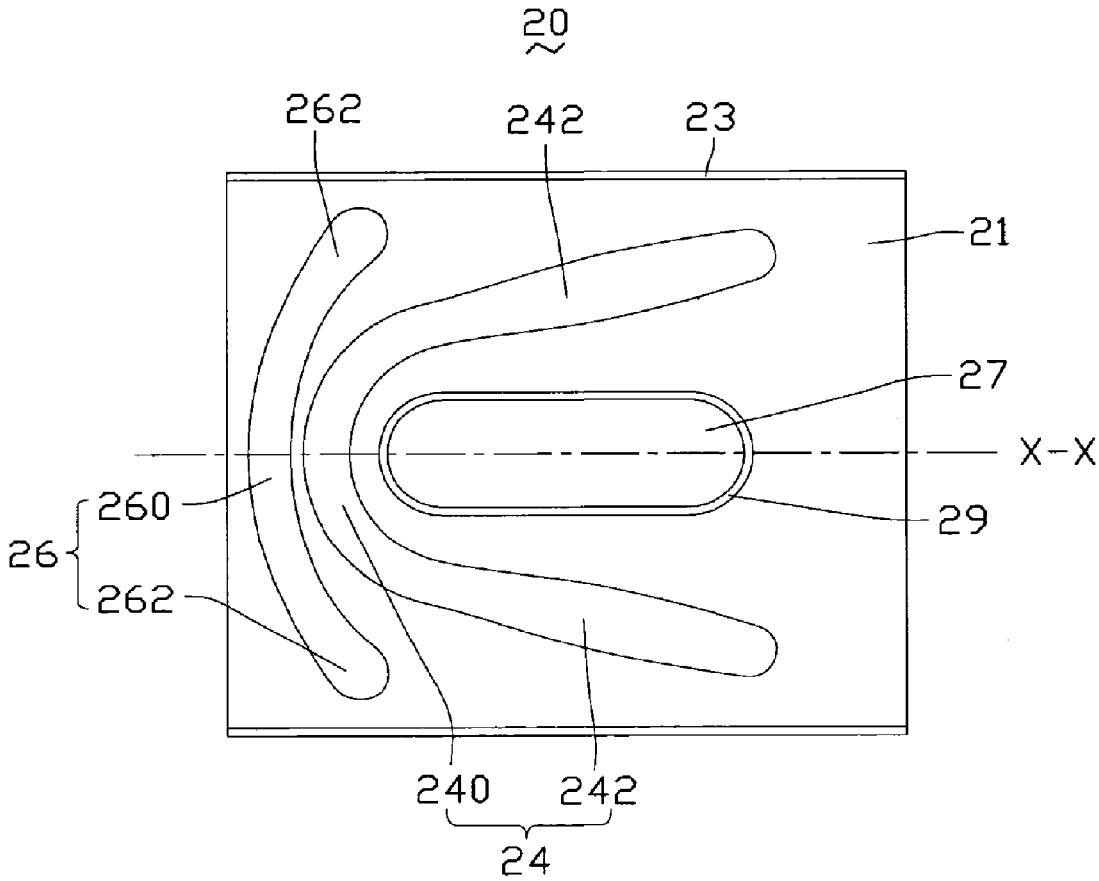
FIG. 4 is a top plan view of one of the fins of FIG. 2.
Figure 5:
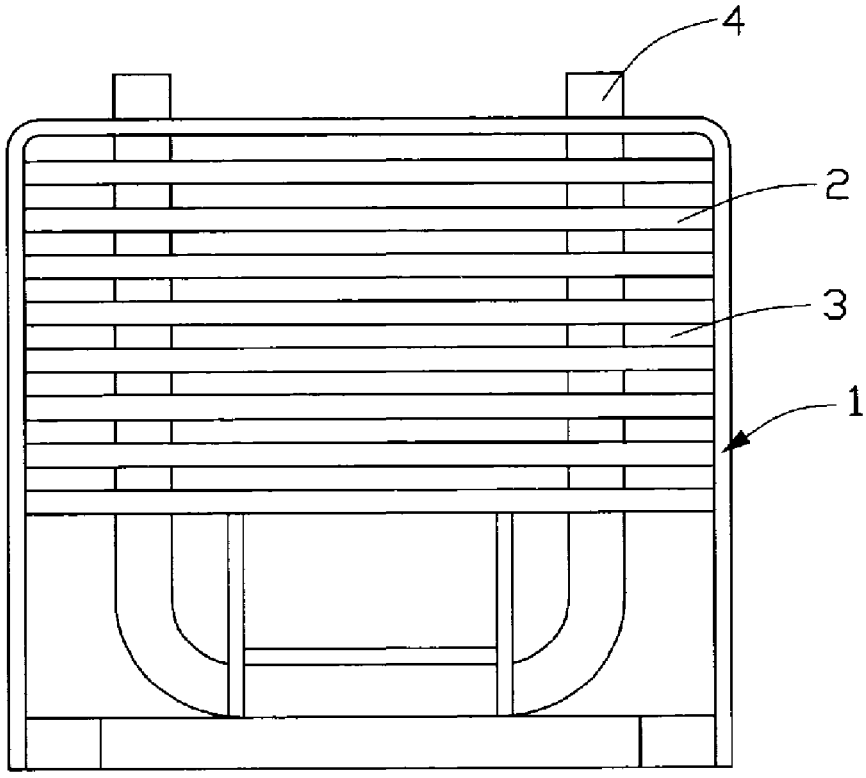
FIG. 5 (RELATED ART)
FIG. 5 is a side view of a conventional heat sink.

Referring to FIGS. 2-4, the fin unit 10 comprises a plurality of stacked fins 20 parallel to each other. Each fin 20 has a main body 21 which has a reference surface 211 and a base surface 212, and two hems 23 bent from two opposite side edges of the main body 21. Distal edges of the hems 23 of each fin 20 contact with the base surface 212 of an adjacent fin 20, and the height of these hems 23 is thus equal to the distance between the two neighboring fins 20. A flow channel 25 is formed between each two neighboring fins 20 to channel the airflow generated by the fan 50. A through hole 27 is defined in each of the fins 20 for receiving the heat pipe 30. The shape and size of the through hole 27 can change according to the heat pipe 30. The through hole 27 in this preferred embodiment of the present invention has nearly an elongated rectangular shape with two arc ends, and the through hole 27 is symmetric to the axis X-X. A circle flange 29 extends upwardly from the border of the through hole 27 in the reference surface 211 of each fin 20, and the height of flange 29 is also nearly equal to the distance between two adjacent fins 20. When the fin unit 10 is assembled together, the flanges 29 of each fin 20 contact the border of the through hole 27 in the base surface 212 of an adjacent fin 20. Thus, the through hole 27 cooperatively forms a columned space for the heat pipe 30 extending through, and the flanges 29 enclose and contact with the heat pipe 30, which enlarges the contacting surface area between the heat pipe 30 and the fins 20. So, heat absorbed by the heat pipe 30 can be quickly transferred to the fins 20 for further dissipation.

A guiding structure 22 comprises two spaced first and second guiding members 24, 26 located around the through hole 27 and extruding from the reference surface 211 of each fin 20. Two concaves 244, 264 corresponding to the two guiding members 24, 26 are formed in the base surface 212 of the fin 20. The first guiding member 24 located in inner side is nearer to the through hole 27 compared to the second guiding member 26. The first guiding member 24 has a parabola shape with a central axis extending through the heat pipe 30. Referring to FIG. 4, the two guiding members 24, 26 each comprise a middle portion 240,260 and two sloping side portions 242,262 extending from the middle portion respectively. The distance between the first guiding member 24 and the axis X-X decreases slowly along the direction of the airflow (as indicated by the arrows in FIG. 1). The distance between the second guiding member 26 and the axis X-X also decreases along the direction of the airflow. A tapered space is formed and surrounded by the first guiding member 24. The angle formed between the two side portions 262 of the second guiding member 26 is larger than that formed between the two side portions 242 of the first guiding member 24, and another tapered space is therefore formed between the second guiding member 26 and the first guiding member 24. The tapered spaces are capable of guiding the airflow to flow to and concentrate at the area near to the heat pipe 30 in each fin 20.

The heat pipe 30 further comprises a condensing section (not labeled) extending in the through holes 27 of the fins 20. The condensing section thermally connecting with the fins 20 at the flange 29. Because of the fast heat conductive capacity of the heat pipe 30 and enlarged contacting surface area between the heat pipe 30 and the fins 20, heat is conducted from heat pipe 30 to fins 20 effectively and evenly.

During the operation of the heat-generating electronic device, the evaporating section of the heat pipe 30 absorbs heat generated by the heat source. The working fluid that is contained in the inner side of the heat pipe 30 absorbs heat and evaporates substantially and moves to the condensing section. Evaporated working fluid is cooled at the condensing section and condensed. The heat is released. Finally, the condensed working fluid flows back to the evaporating section to begin another cycle. By this way, the working fluid absorbs/releases amounts of heat. The heat generated by the heat-generating electronic device is thus transferred from the heat pipe 30 to the fins 20 almost immediately.

As the fins 20 are likely to have significant heat resistance, a hot area is formed around the through holes 27, where it is adjacent to the heat pipe 30 in each fin 20. The temperature in this hot area is higher compared to the rest of the fins 20. After the forced airflow generated by the fan 50 flows into the flow channels 25, the two side portions 242 of the first guiding member 24 guides the airflow to flow to the hot area around the heat pipe 30. Thus the heat in this area can be efficiently carried away by airflow. The second guiding members 26 each is located outside of the first guiding member 24, having the same function as the guiding member 24 which can assistant in guiding the airflow nearer to the heat pipe 30. Furthermore, width of the spaces surrounded by the first and second guiding members 24, 26 decreases gradually along the direction of the airflow, which results in the speed of the airflow being increased to thereby increase heat-dissipating efficiency of the fin unit 10. Due to the influence of viscosity, a laminar air envelope will be form on the surface of the each fin 20, when the airflow passes through the flow channel 25, but if the airflow meets a barrier during it's flowing process, a vortex is formed around the barrier. The guiding structure 22 acts as a barrier arranged in the flow channel 25, destroying the laminar air envelope formed on the surface of each fin 20, causing turbulence in the airflow. In addition, two concave hollows 244, 264 are formed corresponding to the two guiding members 24, 26 on the base surface 212 of each fin 20. The arrangement of these concave hollows 244, 264 causes the base surface 212 of each fin 20 to be a caved plane. The two concave hollows 244, 264 have the same function as the guiding members 24, 26, which cause the turbulence in the airflow. Heat exchange effect between the airflow and the fins 20 is therefore improved. The heat-dissipating efficiency of the heat sink is thus increased. The concave hollows 244, 264 are formed in each fin 20 as a whole in the preferred embodiment by punching or other means, to simplify manufacturing.

While the invention has been described in connection with what is presently considered to be the most practical and preferred embodiment, it is to be understood that the invention is not limited to the disclosed embodiments, but, on the contrary, is intended to accommodate various modifications and equivalent arrangements. The heat sink in accordance with the preferred embodiment of the present invention comprises the guiding structure 22 which includes two guiding members 24, 26. Preferably, the number and the shape of these guiding members 24, 26 can change according to the fins 20 and the heat pipe 30. There can be one or more of each of them, and their shape also is not limited to the parabola shape. A common caved line shape, streamline shape or other kinds which have smaller flow resistance and form a tapered space decreasing gradually along the direction of the airflow, etc can be considered, so as to guide the airflow to flow to the hot area efficiently.

What is claimed is:

1. A heat sink comprising:

a plurality of parallel fins with a flow channel formed between any of two neighboring fins for an airflow flowing therethough;

a heat pipe extending through the fins; and a guiding member having a curved shape being arranged in the channel around the heat pipe for guiding the airflow flowing adjacent to the heat pipe; wherein the guiding member is formed on a face of each the fins and a concave hollow corresponding to the guiding member is formed at an opposite surface of each of the fins.

2. The heat sink of claim 1, wherein a tapered space is formed on a surface of each of the fins defined by the guiding member and the space decreases gradually along the flowing direction of the airflow, the heat pipe being located in the space.

3. The heat sink of claim 2, further comprising a cooling fan being located at a side of the fins for generating the airflow.

4. The heat sink of claim 2, wherein the guiding member is arranged symmetrically to the heat pipe.

5. The heat sink of claim 2, wherein the guiding member has a parabola shape.

6. The heat sink of claim 2, further comprising an additional guiding member, an additional tapered space being formed on the surface of each of the fins between the guiding member, and the additional guiding member.

7. A heat sink comprising:

a heat pipe; and a plurality of parallel fins stacked along the heat pipe, a flow channel being formed between each of two neighboring fins for an airflow flowing therethough, wherein at least one curved guiding member is extruded from each fin for guiding the airflow toward the heat pipe; wherein the guiding member has a parabola shape which has a central axis extending through the heat pipe; a distance between the guiding member and the axis decreases gradually along the flowing directions of the airflow; two guiding members are separately arranged in each fin, and a tapered space is formed between the two guiding members and decreases gradually along the flowing direction of the airflow.

8. The heat sink of claim 7, wherein one through hole is defined in each of the fins for the heat pipe extending through, and the guiding member is symmetrically arranged around the heat pipe.

9. A heat sink comprising:

a plurality of fins stacked together, each fin defining a hole, a flange extending from a first face of the each fin around the hole, and a first guiding member protruding from the first face and around the flange; and a heat pipe extending through the hole and thermally connecting with the flange the first guiding member has a diverged side and a converged side, an airflow flowing first through the diverged side of the guiding member, the flange and then the converged side;

wherein the first guiding member defines a tapered space and the flange is located in the spaced space.

10. The heat sink of claim 9, wherein the first guiding member has a parabola shape and an axis of the first guiding member extends through the heat pipe.

11. The heat sink of claim 10 further comprising a second guiding member protruding from the first face of the each fin, the first guiding member being located between the flange and the second guiding member.

12. The heat sink of claim 11, wherein the first and second guiding member forms concaves on a second face of the each fin opposite the first face thereof.

13. The heat sink of claim 11, wherein the second guiding member is curved and is symmetrical to the axis of the first guiding member.

14. The heat sink of claim 13, wherein the second guiding member has a curvature larger than that of the first guiding member.

15. The heat sink of claim 12, wherein the second guiding member is curved and is symmetrical to the axis of the guiding member.

* * * * *